US005303760A

United States Patent [19]

Perez

[11] Patent Number: 5,303,760

[45] Date of Patent: Apr. 19, 1994

[54] BLIND COVERING APPARATUS AND METHOD FOR CHANGING DECOR ON VERTICAL WINDOW BLINDS

[76] Inventor: Joe A. Perez, 5525 S. Mission Rd. #5303, Tucson, Ariz. 85746-2281

[21] Appl. No.: 20,642

[22] Filed: Feb. 22, 1993

[51] Int. Cl.[5] ..... E06B 3/06

[52] U.S. Cl. ..... 160/236; 160/900; 40/505; 283/36; 283/37; 283/41

[58] Field of Search ..... 160/236, 900, 166.1, 160/10; 283/36, 37, 41; 40/503, 504, 505, 624

[56] References Cited

U.S. PATENT DOCUMENTS

| | | | |
|---|---|---|---|
| 4,049,038 | 9/1977 | Hyman et al. | 160/166 |
| 4,195,680 | 4/1980 | Hayman et al. | 160/166 |
| 4,628,980 | 12/1986 | Le Houiller | 160/166 |
| 4,911,220 | 3/1990 | Hiller | 160/236 |
| 5,029,413 | 7/1991 | Jovanovic | 160/236 X |
| 5,101,876 | 4/1992 | Zak | 160/236 |

FOREIGN PATENT DOCUMENTS

| | | | |
|---|---|---|---|
| 226669 | 7/1987 | European Pat. Off. | 160/236 |

*Primary Examiner*—Blair M. Johnson
*Attorney, Agent, or Firm*—Victor Flores

[57] ABSTRACT

A window blind covering arrangement including a set of window blind slat cover members that detachably fit over existing window blind slats for purposes of changing the associated existing decor. Each blind cover member including attachment features that facilitate a fast way of slip-over attachment to the structure associated with the existing window blind slats. Each blind slat cover member is provided with a code member that is associated with a panoramic scene portion of a larger composite panoramic scene which is depicted by the full set of slat cover members. The coded blind slat cover members facilitate selecting and installing a proper sequence of blind slat cover members to produce the composite panoramic scene of a preselected subject, such as a sports scene, a mountain scene, a seaside view, a city lights scene, or of an other subject. The displaying of the composite panoramic scene being controlled by selectively operating the window blind drawing mechanism.

13 Claims, 2 Drawing Sheets

BLIND COVERING APPARATUS AND METHOD FOR CHANGING DECOR ON VERTICAL WINDOW BLINDS

FIELD OF THE INVENTION

The present invention relates to window blinds and to the decor resulting from the treatment of the exterior surface of the blind structure. More particularly, the present invention relates to window blinds and to blind cover product having structure which facilitates changing the exterior decor of an existing window blind arrangement.

BACKGROUND OF THE INVENTION

The prior art teaches that window blinds are a home furnishing item which contribute greatly to the outcome of an interior decorating project. The window blinds may be used as the primary window treatment, or they may be used to complement a combination including drapes and window blinds arrangement. The present invention is directed at window blinds that are the primary form of window treatment, and which have an exterior surface treatment, including color, combination of colors, or a design pattern. The decorative window blinds commercially available are offered in a variety of lengths, width and material. The material may be a fabric strip or a colored plastic slat. The fabric strips or plastic slats are elongated to cover a window, or a wall area, typically in a vertical arrangement of a plurality of the slats. The louver-type action of the blinds is facilitated by a pivoting hardware interconnection mechanism disposed at each blind which in concert respond to action to provide an open or closed louver state of the blind to either expose, or not expose the blind's larger surface area. The mechanism, in combination with a traverse member mechanism anchored to a wall, provides means for support and also a means to group and move all of the blind members to one or both sides. The fabric strips typically require a weight at a bottom end to help keep the elongated drapery look, and further require a bottom end interconnection between the plurality of fabric strips to cause the bottom end to follow the upper end initiated louver-type action. Because of the stiff properties associated with the plastic slat type of blind, a window blind arrangement using the plastic slat blinds does not require the bottom end follower interconnection to effect a complete louvered opening and closing of the blinds. Regardless of the material, the decor associated with the exterior surface of the blinds is the decor which will stay on the window blinds until the entire window blind arrangement is replaced with another window blind having a different decor.

While some prior art is known which is directed at replacement of blind panels and thereby change the decor, see generally U.S. Pat. Nos. 4,049,038, 4,195,680 and 4,628,980. These prior art teachings are not directed at blind cover structure, as is the present invention. Rather, the prior art teaches a complete blind system whereby the consumer must have originally installed a particular blind structure member which is designed to accept the replaceable decor-containing blind panel member. The system's interdependency is viewed as a limited way of changing the decor of window blinds in that replacement is only possible if the consumer has that particular window blind system.

Additionally, there is no window blind system known that changing the decor by providing a panoramic scene, of a subject, such as a mountain scene, a seaside view, a city lights scene, etc., by opening and closing the window blinds.

Thus, a need is seen to exist for a window blind covering structure adapted to fit over existing blind structure for purposes of changing the decor associated with the existing window blind arrangement.

A need is further seen to exist for a window blind covering arrangement which contains blind cover members that not only conveniently fits over an existing blind structure to change the decor treatment, but that additionally provide, in combination with other blind cover members, a panoramic scene of a subject on at least one surface of the plurality of blinds.

SUMMARY OF THE INVENTION

Accordingly, the primary object of the present invention is to provide a window blind covering structure adapted to fit over existing blind structure for purposes of changing the decor associated with the existing window blind arrangement.

Another object of the present invention is to provide a window blind covering arrangement which contains blind cover members that not only conveniently fit over an existing blind structure to change the decor treatment, but that additionally provide, in combination with other blind cover members, a panoramic scene of a subject on at least one surface of the plurality of blinds.

The foregoing objects are accomplished by providing a window blind covering arrangement comprising a plurality of blind slat cover members sized for slipping over and attaching to an existing plurality of blind slat members. In a preferred embodiment, each blind slat cover member of said plurality of blind slat cover members is provided with a code member that corresponds to a panoramic scene portion of a larger composite panoramic scene depicted on at least one combined exterior surface of said plurality of blind slat cover members. The arrangement includes decode information for installing the blind cover members in accordance with the code provided on each blind cover to assure proper display of the composite panoramic scene. Thus, when installed over existing blind slats, and with the aid of the decode information provided, the composite panoramic scene is produced to provide the desired change in decor.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figure 1:
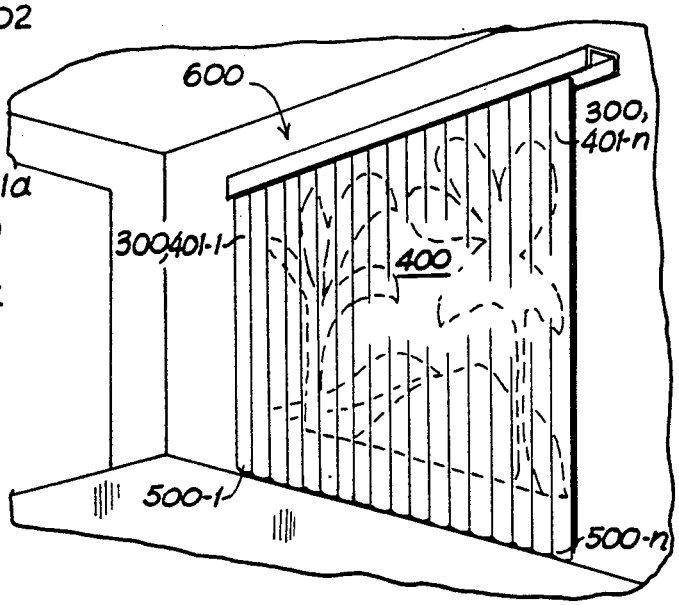
FIG. 1 is a perspective view of the present invention illustrating a plurality of installed blind cover members displaying a panoramic scene.

Referring now to FIG. 1 where a window blind covering arrangement 600, according to the present invention, is shown installed over an existing window blind arrangement. The covering arrangement 600 combines a plurality of blind cover members 300 to display a panoramic scene 400 comprised of a plurality of panoramic scene portions 401-1 through 401-*n* having corresponding code 500-1 through 500-*n*. The panoramic scene 400 is by example, in that the decor treatment that may be provided on the surfaces of the blind cover members 300 may be only a different color, or a different design pattern which is repeated on every blind cover member 300 to change the decor from that provided on the existing window blind arrangement.

Figure 2:
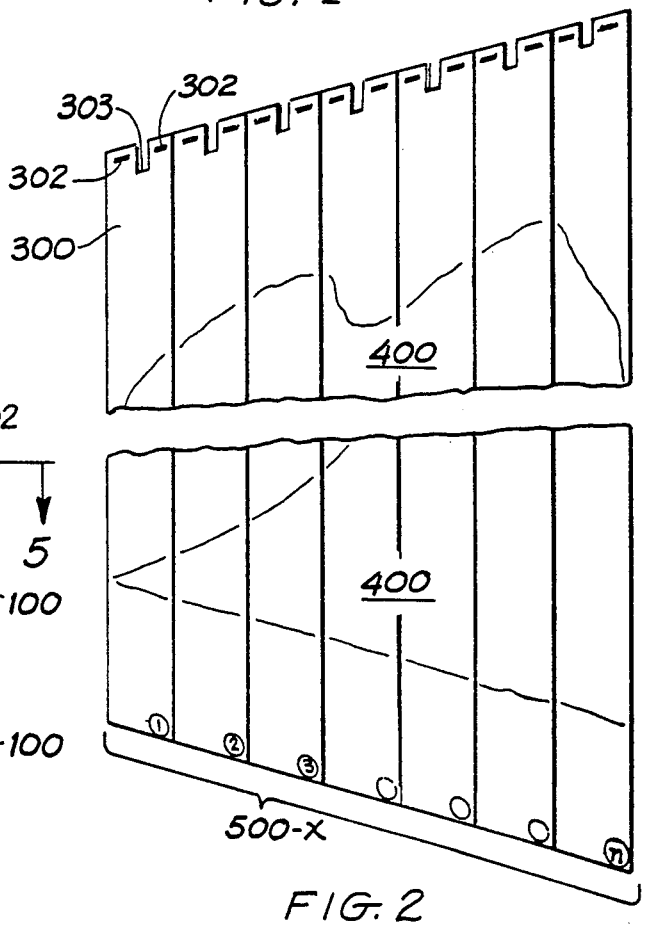
FIG. 2 is a segmented perspective view of a prearrangement of the plurality of blind slat cover members showing the attachment indents at the upper end of each cover member and a numeral code located at a lower end of each cover member that aids in properly installing the cover members to display the composite panoramic scene.

FIG. 2 shows a pre-arrangement of the plurality of blind slat cover members 300 showing, by example, attachment indents 302 provided at the upper end of each cover member. Also shown is a notch 303 provided for purposes of interfacing with a louver action mechanism 200 shown in FIG. 3. Further, and also by example, a numeral code (1, 2, 3, n), denoted generally by 500-*x*, is provided at the bottom of the blind cover members 300 to assure that the panoramic scene is properly and sequentially displayed. The arrangement includes decode information (not shown) that relates to the numeral code and corresponding individual panoramic scene portions that form the composite panoramic scene 400.

Figure 3:
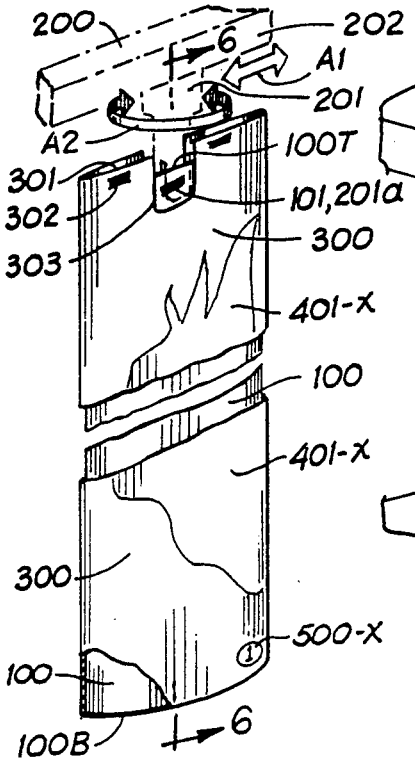
FIG. 3 is a segmented perspective view of the present invention showing a blind cover member, formed having a sleeve-like body shape, installed over and attached to a blind slat member supported by a blind drawing and support mechanism provided with an existing window blind arrangement.

FIG. 3 is a segmented perspective view of the present invention showing a single blind cover member 300 installed over an existing blind slat member 100 covering the entire slat body from top 100T to bottom 100B. Blind cover member 300 being preferably formed having a sleeve-like body shape with an opening 301 sized to accept a similar body shape associated with slat member 100. The types of material suitable for fabricating cover member 300 may vary, but may include a fabric or plastic material. For example, cover member 300 may be a nylon material shaped in a sleeve-like shape body, having either one or both exterior surfaces designed with a panoramic scene portion, designated 401-*x* (x=1−n) and with a corresponding code member designated 500-*x* (x=1−n). Alternatively, the decor treatment may be a mere color treatment or design pattern repeated on all of the cover members (not shown). The decor-options are many as is customary in the interior decorating field.

Figure 5:
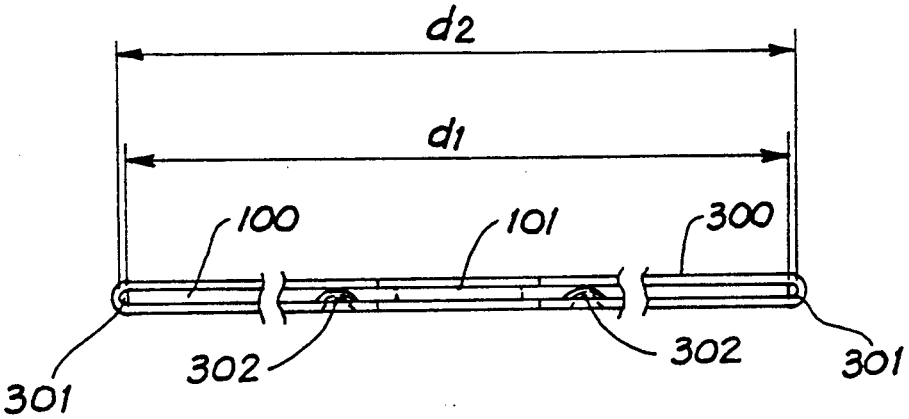
FIG. 5 is a top view taken along line 5—5 in FIG. 4, showing the attachment indents that fit atop an upper edge of the existing window blind slat.

A key aspect of cover member 300 is illustrated in FIG. 5, namely that the dimensional relationship between cover member 300 and existing blind slat 100 being that inner dimension d2 of opening 301 is greater than outer dimension d1 associated with blind slat 100. This dimensional relationship between d1 and d2 facilitates the preferred slip-over manner of installing cover member 300 to blind slat 100, as depicted by arrow A3 in FIG. 6.

Figure 4:
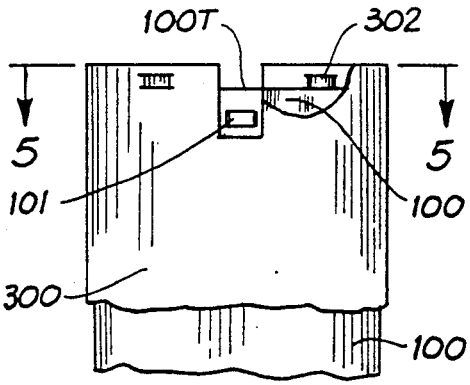
FIG. 4 is a perspective view of the upper portion of a blind cover member, in accordance with the present invention, showing the attachment indents that support the blind cover member to the existing window blind slat and also showing the notch opening that facilitates fitting over the louver action mechanism provided on the existing window blind arrangement.

Referring back to FIG. 3, and also to FIG. 4, cover member 300 is formed having indents 302 that protrude into the interior of opening 301. Indents 302 are rigid elements and urge against the exterior surface of blind slat member 100 while being installed over blind slat 100 and are shaped to be disposed over the top edge 100T of blind 100 in a hook-like manner, see FIGS. 5 and 6, to support the cover 300. Also provided on cover member 300 is a notch 303 which facilitates placement over louver action mechanism 201 which has a hook-end 201*a* that is typically the primary means of vertically supporting existing blind slat members 100 via slot 101.

Figure 6:
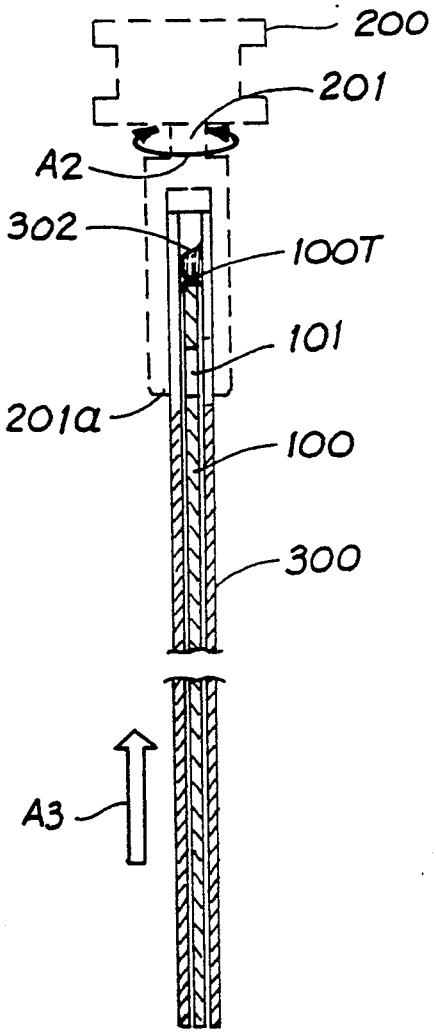
FIG. 6 is a cross-sectional view taken along line 6—6 in FIG. 3 showing details of the installed blind cover member, and also showing the blind cover slip-over action, the manner of support provided by the attachment indent, and the louver action which facilitates displaying or not displaying the panoramic scene.

FIGS. 3 and 6 show the typically existing drawing mechanism 200 in a window blind arrangement, including a traverse rod member 202 and the louver action member 201. This previously provided mechanism 200 facilitates a user to either display or not display the panoramic scene 400. The traverse rod member 202 facilitates side movement A1 to group all of the covered blinds to one or both sides, while pivotal louver action A2 of member 201 facilitates a closed/display state, or an open/non-display state of the covered window blind arrangement 600.

Therefore, while the present invention has been shown and described herein in what is believed to be the most practical and preferred embodiment, it is recognized that departures can be made therefrom within the scope of the invention, which scope is therefore not to be limited to the details disclosed herein but is to be accorded the full scope of the claims so as to embrace any and all equivalent apparatus.

I claim:

1. A method of charging the decor of an existing window blind arrangement, said method comprising the steps of:

(a) providing a window blind covering arrangement, said covering arrangement comprising a plurality of blind slat cover members sized for slipping over and attaching to an existing plurality of blind slat members, each blind slat cover member of said plurality of blind slat cover members having a code member that corresponds to a panoramic scene portion of a composite panoramic scene depicted on at least one combined exterior surface of said plurality of blind slat cover members, said composite panoramic scene producing said change in decor;

(b) providing decode information for displaying said composite panoramic scene; and (c) selecting and installing said plurality of coded blind slat cover members over said existing plurality of blind slat members in accordance with said provided decode information to produce said composite panoramic scene and effect said change in decor in said existing window blind arrangement.

2. A method of changing the decor of a window blind arrangement as described in claim 1, wherein said step of installing includes:

concurrently securing each coded blind slat cover member to a selected one of said existing blind slat members.

3. A method of changing the decor of a window blind arrangement as described in claim 2, wherein said step of installing includes:

pre-arranging said plurality of coded blind slat cover members in accordance with said provided decode information to preview said composite panoramic scene prior to performing said installing step.

4. A method of changing the decor of a window blind arrangement as described in claim 1, further including the step of:

(d) controlling display of said produced composite panoramic scene by selectively operating a blind drawing and support mechanism provided with said existing window blind arrangement.

5. A window blind covering arrangement for producing a change in decor, said arrangement comprising:

a plurality of blind slat cover members, each blind slat cover member of said plurality of blind slat cover members being sized for slipping over an existing blind slat member of an existing window blind arrangement, each blind slat cover member having an attachment means for effecting attachment to said existing blind slat member;

a decor treatment provided on at least one exterior surface of each blind slat cover member, said decor treatment producing said change in decor, said decor treatment comprising a composite panoramic scene depicted on at least one combined exterior surface of said plurality of blind slat cover members, at least one exterior surface of each blind slat cover members, said plurality of blind slat cover members having a panoramic scene portion of said composite panoramic scene depicted thereon;

a code member provided on each blind slat cover member, said code member being associated with said panoramic scene portion to facilitate an installation that properly displays said composite panoramic scene; and decode information relating to each of said code members to aid during installation to properly display said composite panoramic scene.

6. A window blind covering arrangement for producing a change in decor as described in claim 5, wherein:

each blind slat cover member of said plurality of blind slat cover members comprises a sleeve structure.

7. A window blind covering arrangement for producing a change in decor as described in claim 6, wherein:

said sleeve structure being formed from a plastic material.

8. A window blind covering arrangement for producing a change in decor as described in claim 6, wherein:

said sleeve structure being formed from a fabric material.

9. A window blind covering arrangement for producing a change in decor, said arrangement comprising:

a plurality of blind slat cover members, each blind slat cover member of said plurality of blind slat cover members being sized for slipping over an existing blind slat member of an existing window blind arrangement, each blind slat cover member having an attachment means for effecting attachment to said existing blind slat member;

at least one exterior surface of each blind slat cover member having a panoramic scene portion depicted thereon, said panoramic scene portion being a portion of a composite panoramic scene depicted by said plurality of blind slat cover members; and each blind slat cover member further having a code member associated with said panoramic scene portion to facilitate installation that properly displays said composite panoramic scene.

10. A window blind covering arrangement for producing a change in decor as described in claim 9, further comprising:

decode information relating to each of said code member to aid during installation of said coded blind slat cover members to assure proper display of said composite panoramic scene.

11. A window blind covering arrangement for producing a change in decor as described in claim 9, wherein:

said blind cover member comprises a sleeve structure.

12. A window blind covering arrangement for producing a change in decor as described in claim 11, wherein:

said sleeve structure being formed from a plastic material.

13. A window blind covering arrangement for producing a change in decor as described in claim 11, wherein:

said sleeve structure being formed from a fabric material.

* * * * *